US006230337B1

(12) United States Patent
Barnett

(10) Patent No.: US 6,230,337 B1
(45) Date of Patent: May 15, 2001

(54) ANTI-VACUUM DRAIN COVER

(76) Inventor: Ralph L. Barnett, 2721 Alison La., Wilmette, IL (US) 60091

( * ) Notice: Subject to any disclaimer, the term of this patent is extended or adjusted under 35 U.S.C. 154(b) by 0 days.

(21) Appl. No.: 09/499,981

(22) Filed: Feb. 8, 2000

(51) Int. Cl.[7] ..... E04H 4/00

(52) U.S. Cl. ..... 4/507; 4/504; 4/490; 4/286; 4/290

(58) Field of Search ..... 4/507, 504, 506, 4/509, 496, 490, 292, 290, 289, 288, 287, 286, 652, 650, 653, 640; 210/162, 163, 166

(56) References Cited

U.S. PATENT DOCUMENTS

D. 333,342 * 2/1993 Newhard ..... D23/261
D. 343,228 * 1/1994 Colin ..... D23/261
3,940,804 * 3/1976 Baker et al. ..... 4/172
4,170,047 * 10/1979 Corsette et al. ..... 4/293
5,734,999 * 4/1998 Nicholas ..... 4/507
5,926,865 * 7/1999 Witinski et al. ..... 4/496
6,088,842 * 7/2000 Barnett ..... 4/286

* cited by examiner

*Primary Examiner*—Gregory L. Huson
*Assistant Examiner*—Huyen Le

(57) ABSTRACT

An anti-vacuum drain cover is defined by a centrally supported grating together with at least one outwardly extending tributary tube. When the grating is obstructed, the fluid may still be suctioned through at least one tributary tube preventing the formation of vacuum conditions within the main drain. The outboard end of the tributary tube may be fashioned in an irregular pattern to preclude deliberate blockage with one's hand. The grating may further incorporate an anti-hair entanglement design, such as self shedding cantilever elements, which provide anti-hair snare properties. The tributary tubes may be straight or curved with sufficient length to minimize hair entanglement through the tributary tubes. The outboard ends of the tributary tubes may also be located sufficiently far from the grating to eliminate the possibility of simultaneously blocking all suction sites with a single body.

20 Claims, 2 Drawing Sheets

ANTI-VACUUM DRAIN COVER

FIELD OF THE INVENTION

This invention relates to drain constructions located in the bottom or along the sides of pools, hot tubs, whirlpools or the like, through which water is sucked out and then drained or recirculated through jets or the like, located around the interior perimeter or bottom of the tub or pool. When the drains are discharging, a sealed drain cover will cause a vacuum to develop in a matter of seconds; this vacuum produces either entrapment or evisceration of the pool or tub occupant whose body happens to envelope and seal the drain. Another hazard to the occupant, is drowning due to entrapment resulting from hair entangling in a drain cover. It is thus important to design the drain cover to prevent one from becoming stuck to a drain or having their hair becoming entangled with the drain cover and thus being subject to injury or drowning.

BACKGROUND OF THE INVENTION

In the typical pool and tub, the water is normally pulled out of the pool or tub through a drain system at the base of the tub, into an inlet of a suction pump, and then drained or recirculated back to the pool or tub through jets located around the interior wall of the pool or tub. With the conventional drain, it is possible that one sitting or laying on the drain cover can be held on the drain by the high suction pressure. It is also possible that a person's hair will be caught or suctioned into the drain if the person is sitting or laying next to the drain.

The industry has suggested various methods for eliminating body entrapment and disembowelment by designing drain systems and covers intended to preclude the formation of a vacuum. For example, low-tech solutions, such as convex drain covers tend to prevent complete sealing of the drain. Further, dual interconnected drains prevent a vacuum from being formed when one of the drains is covered. However, such low-tech solutions are easily defeated by occupants of exceptional size or by multiple occupants acting in concert to defeat dual drain systems. Other solutions, such as, pressure detection devices shut the drain system off at critical suction levels. However, such hi-tech solutions raise questions of reliability, calibration, stability, and maintenance capability by the pool's operators.

It is therefore an object of the present invention to provide a drain design that prevents the formation of a vacuum in the drain.

It is yet another object of the present invention to provide a drain design that prevents hair entanglement.

SUMMARY OF THE INVENTION

In accordance with the present invention, there is provided an anti-vacuum drain cover. While having typical drain openings in the top portion of the drain cover, the anti-vacuum drain cover further incorporates tributary tubes extending from the body of the drain cover. The mixture of fluid, from the tributary tubes and the drain cover, into the drain inlet prevents the formation of a vacuum when one of the entrances is covered.

Various alternatives may be used to further prevent hair entanglement or the formation of a vacuum within the drain. For instance, the length of the tributary tubes may be at least 16 inches and the outboard ends of the tributary tubes may be scalloped and/or flared.

In another alternative embodiment of the present invention an anti-vacuum, anti-hair snare drain cover is depicted and disclosed. The additional incorporation of self shedding cantilever elements in the body of the anti-vacuum drain cover provides the anti-hair snare properties. The subject combination design helps to reduce the three recognized drain dangers: body entrapment, disembowelment and hair entanglement.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
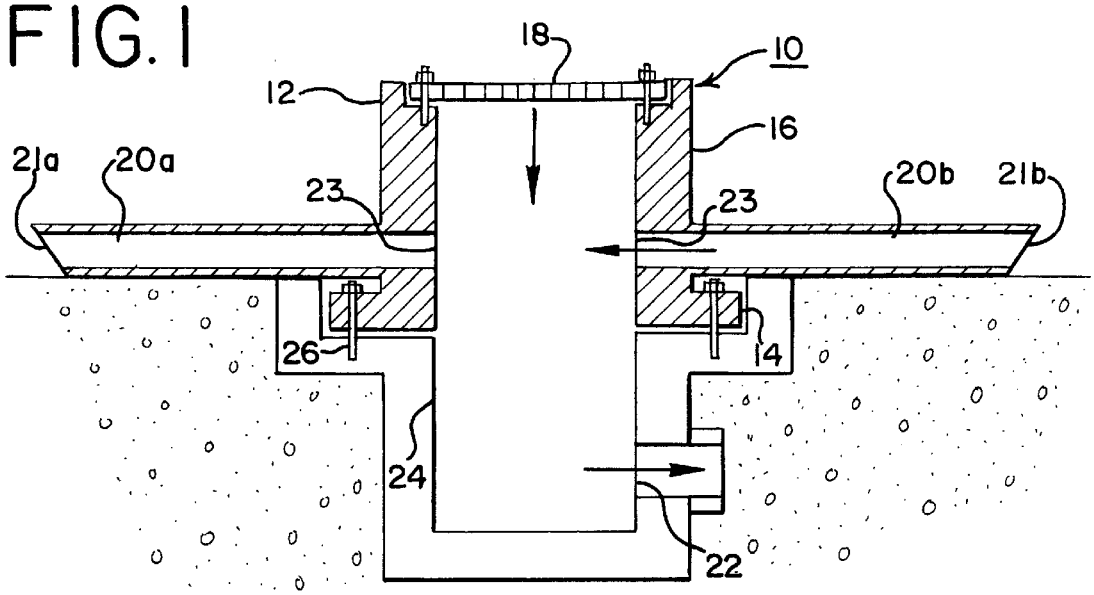
FIG. 1 is a cross-sectional view of the anti-vacuum drain cover secured to a main drain in a pool or tub.

While the invention is susceptible of embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

In the following description, similar components are referred to by the same reference number in order to simplify the understanding of the sequential aspect of the drawings.

Referring to FIG. 1, there is illustrated a cross-sectional view of the preferred embodiment of the present invention. An anti-vacuum drain cover 10, generally referred to herein as the drain cover, is shown. The drain cover 10 is defined by a top portion 12, a bottom portion 14 and a cylindrical body 16. It is fully appreciated by the present invention that the drain cover 10 may be of any predetermined shape or size in order to fit variously sized drain inlets.

Figure 2:
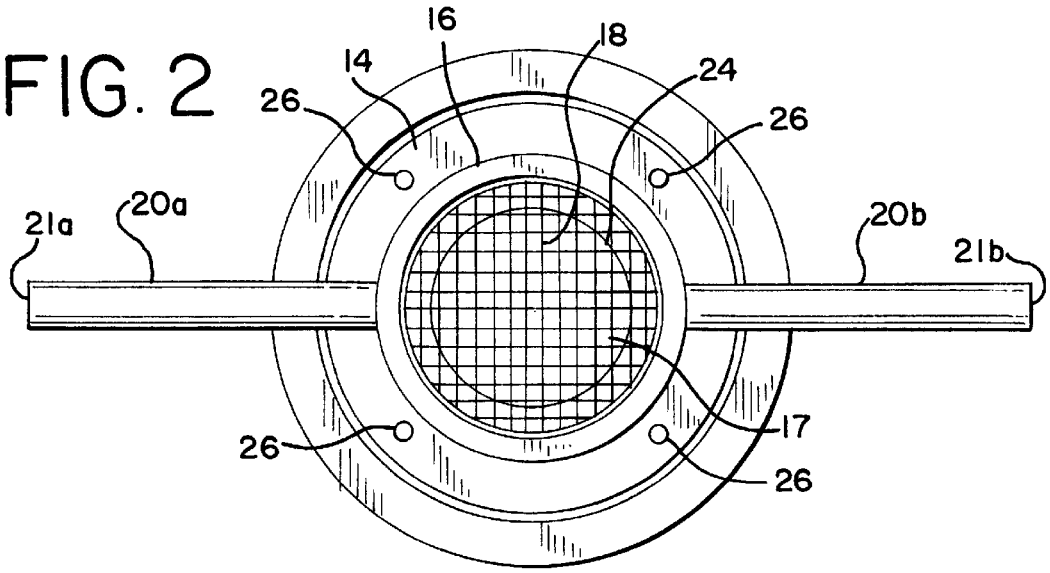
FIG. 2 is a top view of the anti-vacuum drain cover.

The top portion 12 of the drain cover 10 includes drain openings 17 (best seen in FIG. 2). While the drain openings 17 may be integrally formed in the top portion 12 of the drain cover 10, a drain grate 18 (as shown in FIG. 1) may be secured to the top portion 12. Extending from the body 16 is at least one tributary tube 20 through which liquid is suctioned from its outboard end 21. As depicted in FIG. 1, the preferred embodiment employs two tributary tubes 20*a* and 20*b*. Typically, a tube length of at least 16 inches is sufficient to minimize possibly hair entanglement through the tube. To preclude sealing by an occupant's body, however, the distance between the outboard ends, of the two tributary tubes, should be at least approximately 24 inches. It is foreseeable and fully appreciated by the present invention to utilize smaller tube lengths, and to angle the extension of the tubes in various directions.

When the drain is operational, water is suctioned through the drain openings 17 and via inlets 21 and out via 23 of the tributary tubes 20*a* and 20*b*, into a main drain inlet 24 and through an aperture 22 leading to the drain system to be filtered, recirculated or the like. In typical drain covers without tributary tubes, when the drain openings 17 are completely obstructed, the suction through the aperture 22 creates a vacuum within the main drain inlet 24 inhibiting the removal of the obstruction. The present invention, however, prevents the formation of a vacuum because when the grating section is obstructed fluid is still being supplied to the drain via the two tributary tubes.

It can be seen, in FIG. 1, that the drain cover 10 can be freely disposed on the main drain inlet 24, which would, of course, permit the drain to be removed by a trapped individual in the event an upward force is placed thereon. Alternatively, if desired, the drain cover 10 can be fixed in position by fasteners 26, also shown in FIG. 2.

Figure 3A:
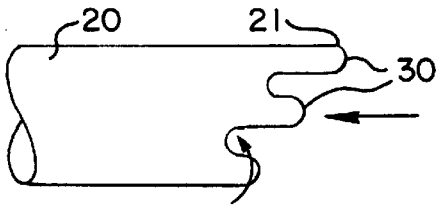
FIGS. 3*a*, 3*b* and 4 are plan views illustrating various outboard ends of the tributary tubes.
Figure 3B:
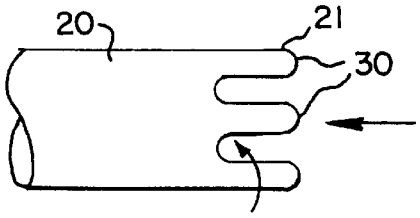
Figure 4:
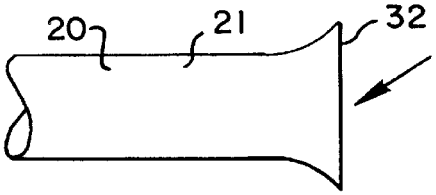

FIGS. 3*a*, 3*b* and 4 show examples of the outboard ends 21 of the tributary tubes 20. As mentioned above, the incorporation of the tributary tubes 20 helps prevent or reduce the formation of vacuum conditions when the drain openings 17 are obstructed. However, exceptionally large occupants or occupants deliberately blocking the water flow into the tributary tubes 20 and the drain openings 17 may still cause the formation of a vacuum. To further reduce the possibility of blocking the entire flow of liquid into the drain system, the outboard ends 21 may include various shapes, which prevent occupants from blocking the entire flow of liquid through the outboard ends.

In FIGS. 3*a* and 3*b* the outboard ends 21 are defined by various scalloped ends 30; FIG. 3*a* illustrates a scalloped end in a vertical plane, while FIG. 3*b* depicts a scalloped end in a horizontal plane. In yet another embodiment of the present invention, the outboard end 21 may be defined by a flared outboard end 32, shown in FIG. 4. The various scalloped ends and the flared end tend to enlarge the passageway into the tributary tubes 20, thereby decreasing the likelihood that an obstruction would block all of the flow into the drain system.

Figure 5:
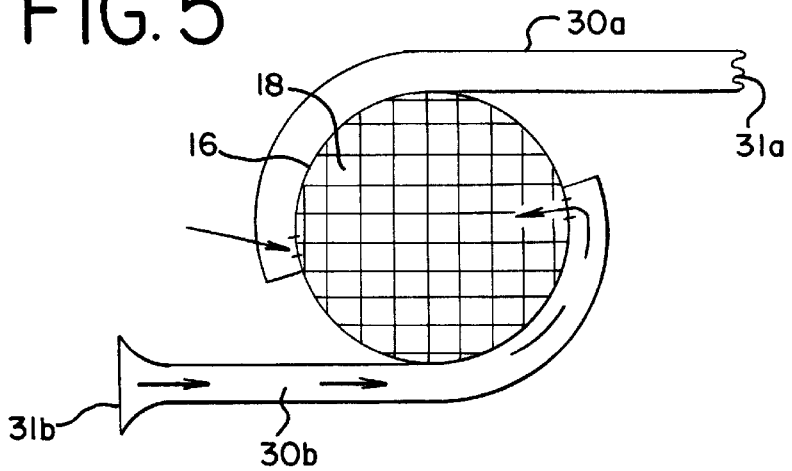
FIG. 5 is a top plan view of the present invention, depicting curved tributary extension tubes.

The tributary tubes may also be curved about the cylindrical body 16, of which one configuration is shown in FIG. 5. The curved tributary tubes provide the ability to incorporate tube lengths in excess of sixteen inches, further minimizing hair entanglement, while providing a compact layout. Also shown in FIG. 5 is the incorporation of various outboard ends for the same drain cover. As shown, one of the tributary tubes 30*a* utilizes a horizontal scalloped end 31*a*, while the other tributary tube 30*b* incorporates a flared outboard end 31*b*.

Tributary tubes may further be oriented to either strengthen or weaken any vortex action caused by the suction of liquid. FIG. 5 shows the tributary tubes 30 oriented such that the flow of fluid is counterclockwise as viewed from the top of the drain cover, weakening the vortex action of the fluid flow in the main drain. If the tributary tubes were pointed in the opposite direction, a clockwise fluid flow would be obtained, strengthening the vortex action.

Figure 6:
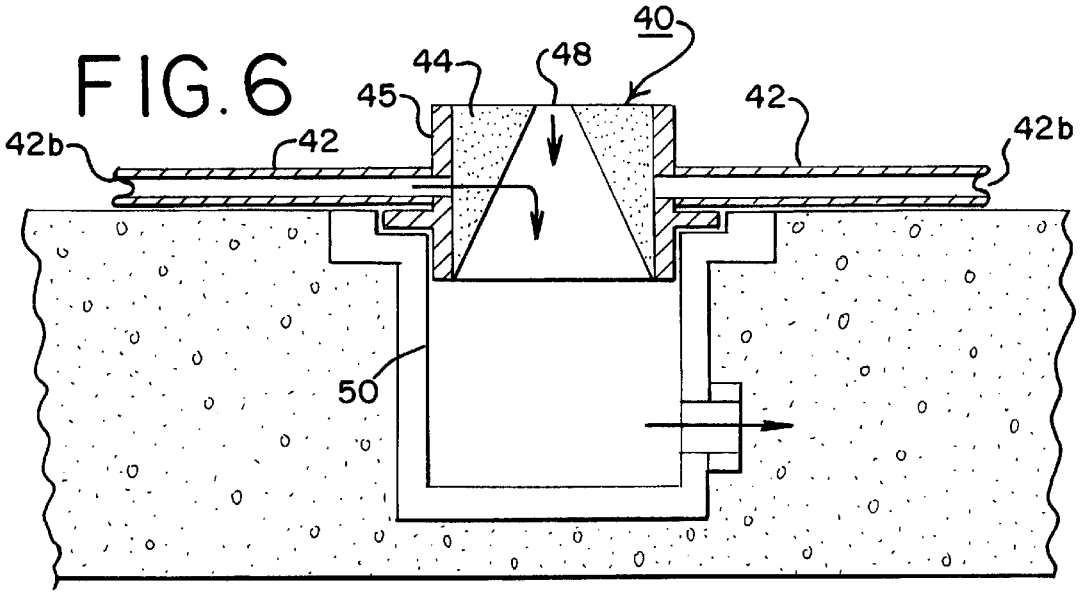
FIG. 6 is another embodiment of the present invention showing a cross-sectional view of an anti-hair entanglement anti-vacuum drain cover.

Referring now to FIG. 6 an anti-vacuum, anti-hair snare drain cover 40 is depicted. The length of the tributary tubes 42 is, as previously described, preferably greater than sixteen inches to minimize hair entanglement. A plurality of self shedding cantilever elements 44 are employed in the drain cover to provide an anti-hair snare property. Illustrated in FIGS. 6 and 7, the self shedding cantilever elements 44 project from the body 45 of the drain cover 40. If an occupant's hair enters the drain cover 40, any portion of an occupant's hair pulled up and against the self shedding cantilever elements 44 slide off of the sloped cantilevers, thereby preventing entanglement of the swimmer's hair in the drain inlet 50.

Figure 7:
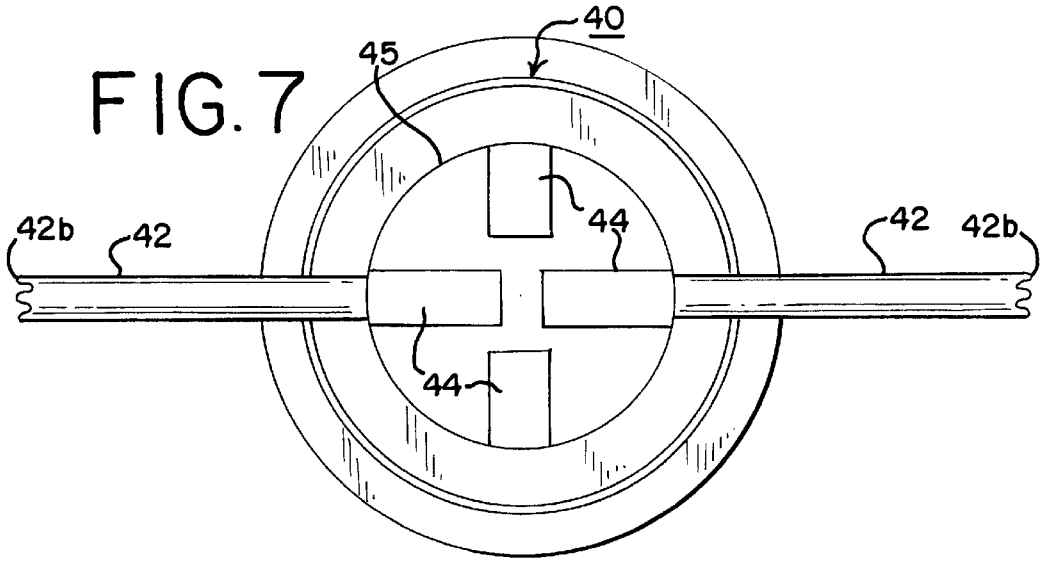
FIG. 7 is a top plan view of the embodiment depicted in FIG. 6.

As illustrated in FIGS. 6 and 7, the outboard ends 42*b* of the tributary tubes 42 are scalloped decreasing the likelihood that an obstruction would block all of the flow into the drain system.

From the foregoing and as previously mentioned, it will be observed that numerous variations and modifications may be effected without departing from the spirit and scope of the novel concept of the invention. It is to be understood that no limitation with respect to the specific methods and apparatus illustrated herein is intended or should be inferred. It is intended, however, to cover by the appended claims all such modifications as fall within the scope of the claims.

What is claimed is:

1. An anti-vacuum drain cover comprising: a body having a top portion, draining openings formed in the top portion through which liquid is suctioned therethrough; at least one tributary tube extending from the body and defining an outboard end and scalloped in the vertical plane through which liquid is suctioned such that when draining openings are being obstructed the liquid suctioned through the tributary tube prevents the formation of vacuum conditions within a drain.

2. An anti-vacuum drain cover comprising: a body having a top portion, draining openings formed in the top portion through which liquid is suctioned therethrough; at least one tributary tube extending from the body and defining an outboard end scalloped in the horizontal plane through which liquid is suctioned such that when the draining openings are being obstructed, the liquid suctioned through the tributary tube prevents the formation of vacuum conditions within a drain.

3. An anti-vacuum drain cover comprising: a body having a top portion, draining openings formed in the top portion through which liquid is suctioned therethrough; at least one tributary tube extending from the body and including a flared outboard end through which liquid is suctioned such that when the draining openings are being obstructed, the liquid suctioned through the tributary tube prevents the formation of vacuum conditions within a drain.

4. An anti-vacuum drain cover comprising: a body having a top portion, draining openings formed in the top portion through which liquid is suctioned therethrough; at least one tributary tube extending from the body and being curved and through which liquid is suctioned such that when the draining openings are being obstructed, the liquid suctioned through the tributary tube prevents the formation of vacuum conditions within a drain.

5. An anti-vacuum chair cover comprising a body having a top portion: draining openings formed in the top portion through which liquid is suctioned therethrough, at least two tributary tubes extending from the body wherein at least one of the tributary tubes is defined by a scalloped outboard end and at least one of the tributary tubes is defined by a flared outboard end through which liquid is suctioned, such that when the draining openings are being obstructed, the liquid suctioned through the tributary tube prevents the formation of vacuum conditions within a drain.

6. The drain cover of claim 5 wherein the tributary tubes are positioned such that the flow of liquid through the tributary tubes and into a drain inlet is counterclockwise.

7. The drain cover of claim 5 wherein the tributary tubes are positioned such that the flow of liquid through the tributary tubes and into a drain inlet is clockwise.

8. An improved drain cover comprising:

a body having a top portion;

drain openings formed in the top portion through which liquid is suctioned therethrough;

the top portion further including entrapped hair self shedding cantilever elements;

at least one tributary tube extending from the cylindrical body through which liquid is suctioned there through, such that when the drain openings are being obstructed, the liquid suctioned through the tributary tube prevents the formation of vacuum conditions within the drain.

9. The drain cover of claim 8 wherein each tributary tube is at least 16 inches in length.

10. The drain cover of claim 9 wherein each tributary tube is defined by an outboard end scalloped in the vertical plane.

11. The drain cover of claim 9 wherein each tributary tube is defined by an outboard end scalloped in the horizontal plane.

12. The drain cover of claim 9 wherein each tributary tube is defined by a flared outboard end.

13. The drain cover of claim 9 wherein at least one tributary tube is curved.

14. A drain cover loosely disposed upon a drain inlet and having drain openings and at least two extending tributary tube openings wherein at least one tributary tube has a scalloped outboard end wherein upon obstructing the drain openings, the formation of a vacuum is prevented by the intake of liquid through the tributary tube openings.

15. A drain cover loosely disposed upon a drain inlet and having drain openings and at least two extending tributary tube openings wherein at least one tributary tube has a flared outboard end wherein upon obstructing the drain openings, the formation of a vacuum is prevented by the intake of liquid through the tributary tube openings.

16. A drain cover loosely disposed upon a drain inlet and having drain openings and at least two extending tributary tube openings wherein at least one tributary tube is curved wherein upon obstructing the drain openings, the formation of a vacuum is prevented by the intake of liquid through the tributary tube openings.

17. A drain cover loosely disposed upon a drain inlet and including entrapped hair self shedding cantilever elements such that hair entering the drain cover is prevented from becoming entrapped, said drain cover also having drain openings and at least two extending tributary tube openings, wherein upon obstructing the drain openings, the formation of a vacuum is prevented by the intake of liquid though the tributary tube openings.

18. The drain cover of claim 17 wherein the tributary tubes are positioned such that the flow of liquid through the tributary tubes and into the drain is counterclockwise.

19. The drain cover of claim 17 wherein the tributary tubes are positioned such that the flow of liquid through the tributary tubes and into the drain is clockwise.

20. The drain cover of claim 17 further including means for fastening the drain cover in place.

* * * * *